US012311245B2

(12) United States Patent
Komane

(10) Patent No.: US 12,311,245 B2
(45) Date of Patent: May 27, 2025

(54) GOLF TRAINING AID

(71) Applicant: Darius Buti Komane, Johannesburg (ZA)

(72) Inventor: Darius Buti Komane, Johannesburg (ZA)

( * ) Notice: Subject to any disclaimer, the term of this patent is extended or adjusted under 35 U.S.C. 154(b) by 87 days.

(21) Appl. No.: 17/951,463

(22) Filed: Sep. 23, 2022

(65) Prior Publication Data

US 2023/0013254 A1 Jan. 19, 2023

Related U.S. Application Data

(63) Continuation of application No. PCT/ZA2021/050022, filed on Mar. 25, 2021.

(30) Foreign Application Priority Data

Mar. 25, 2020 (ZA) ..... 2019/06298

(51) Int. Cl.
*A63B 69/36* (2006.01)
*A63B 71/06* (2006.01)

(52) U.S. Cl.
CPC ..... *A63B 69/3608* (2013.01); *A63B 71/0622* (2013.01); *A63B 2071/0625* (2013.01); *A63B 2071/0655* (2013.01); *A63B 2225/50* (2013.01); *A63B 2225/74* (2020.08)

(58) Field of Classification Search
CPC ..... A63B 69/3608; A63B 71/0622; A63B 2071/0625; A63B 2071/0655; A63B 2225/50; A63B 2225/74; A63B 2071/0694
USPC ..... 473/207–209, 212–218, 266, 269–277
See application file for complete search history.

(56) References Cited

U.S. PATENT DOCUMENTS 4,651,994 A 3/1987 Lee
5,511,789 A * 4/1996 Nakamura ..... A63B 69/3608 473/202
5,588,919 A * 12/1996 Nakamura ..... A63B 69/3608 473/212
6,001,023 A * 12/1999 Sanchez ..... A63B 69/3635 473/270
6,332,845 B1 * 12/2001 Priestley ..... A63B 69/0057 473/409
7,662,048 B2 * 2/2010 Libby ..... A63B 69/3667 473/409

(Continued)

FOREIGN PATENT DOCUMENTS

WO 2004/054662 A1 7/2004

OTHER PUBLICATIONS

International Search Report issued by the Austrian Patent Office for International Patent Application No. PCT/ZA2021/050022, mailed on Jul. 21, 2021.

*Primary Examiner* — Nini F Legesse
(74) *Attorney, Agent, or Firm* — Myers Wolin, LLC

(57) ABSTRACT

A golf training aid (10) that is arranged to he attached to one of the front and back legs (36) of a golfer (30). The golf training aid comprising a monitoring arrangement (14) for monitoring progressive movement of the back leg towards the front leg of the golfer; and an alarm arrangement (16) for alerting the golfer when displacement of the back leg towards the front leg has reached a predetermined position, to enable the golfer to make necessary bodily movements to swing a club that is held by the golfer.

7 Claims, 5 Drawing Sheets

(56) References Cited

U.S. PATENT DOCUMENTS

| | | | | |
|---|---|---|---|---|
| 7,749,109 | B2 * | 7/2010 | Jang | A63B 69/3608 473/409 |
| 9,254,430 | B2 * | 2/2016 | LaSala | G09B 19/0038 |
| 2004/0121849 | A1 * | 6/2004 | Curkovic | A63B 69/3608 473/277 |
| 2011/0306434 | A1 | 12/2011 | Crabtree | |
| 2016/0206944 | A1 | 7/2016 | Dastrup | |
| 2017/0189781 | A1 | 7/2017 | Vehslage | |

* cited by examiner

GOLF TRAINING AID

CROSS REFERENCE TO RELATED APPLICATIONS

This application is a continuation of International Application No.: PCT/ZA2021/050022, filed on Mar. 25, 2021, which claims priority from South African Patent Application No. 2019/06298, filed on Mar. 25, 2020, the contents of each of which are incorporated herewith by reference.

FIELD OF INVENTION

This invention is in the field of training aids, in particular golf training aids.

BACKGROUND OF INVENTION

The source of great power and control in the golf swing start with the proper rotation and weight shift of the lower body, proper downswing sequence starts with the lower body rotating towards the target followed by the upper body, and finally allowing the arms and club swing past the body to strike the ball and finish the swing in a balanced position with the body of the golfer facing the intended target.

Most golfers especially the amateurs struggle with proper rotation of the lower body during the downswing, they tend to slide their hips towards their target instead of rotating them to a finishing position where the chest, belt buckle and head will be facing their target and the weight shifted to the front leg, bad rotation leads to poor ball striking.

The present invention seeks to provide a device that can address the aforementioned problem.

SUMMARY

According to an aspect of the invention there is provided a golf training aid arranged to be attached to a front leg of a golfer, the golf training aid comprising:

- a monitoring arrangement for monitoring progressive rotational displacement of a back leg relative to the front leg of the golfer; and
- an alarm arrangement for alerting the golfer when rotational displacement of the back leg relative to the front leg has reached a predetermined position.

In an embodiment, the training aid may comprise a housing arranged to be attached to the front leg of the golfer or positioned relative to one of the legs of the golfer; and the alarm arrangement and the monitoring arrangement may be fitted to the housing.

In an embodiment, the golf training aid may comprise an attachment element for facilitating the attachment of the golf training aid to the leg, preferably front leg, in particular above the knee of the front leg of the golfer.

In an example embodiment, the monitoring arrangement may comprise a protruding member, typically a shaft, extending from the housing, the housing being positioned above the knee of the golfer and arranged such that the protruding member faces the back leg of the golfer, and the protruding member being arranged to be displaced between a rest configuration and a displaced, pivoted configuration in which the protruding member is pivoted relative to the housing and front leg of the golfer, in use.

In an embodiment, the housing may define a slot opening through which the protruding member may extend, and the slot opening may be elongate and curved to allow the protruding member to be slidably displaceable along the length of the curved slot opening and along a pivot axis, between the rest configuration and the displaced, pivoted configuration.

In an embodiment the golf training aid may comprise a restricting mechanism fitted in the housing for restricting displacement of the protruding member relative to the housing when pivoted up to a predetermined position relative to the housing.

In an embodiment, the restricting mechanism may comprise a toothed ratchet wheel that is secured to the housing, the ratchet wheel comprising a series of radially spaced asymmetric teeth, the protruding member extending away from the ratchet wheel and arranged to be rotationally displaced relative to the ratchet wheel, and a spring-loaded driving pawl extending from the protruding member for engaging the teeth of the ratchet wheel to allow the protruding member to pivot relative to the ratchet wheel when being displaced between the rest and displaced configurations.

In an embodiment, the restricting mechanism may comprise a stoper element fitted to the housing for engaging the driving pawl when the protruding member has been displaced up to a predetermined point relative to the housing, to disallow the protruding member from being displaced beyond the predetermined point.

In an embodiment, the stopper element may extend from one or more teeth of the ratchet wheel or in the housing to disallow the driving pawl from moving past the stopper element while the protruding member is being displaced between the rest and pivoted configurations.

In an embodiment, the golf training aid may comprise a release mechanism for enabling the driving pawl to disengage from the stopper element, to enable the protruding member to be released and displaced in a first direction towards the rest configuration.

In an embodiment, the monitoring arrangement may comprise a trigger, including a switch or sensor, which is arranged to trigger the alarm arrangement when the protruding member has been displaced relative to the housing up to the predetermined point.

In an embodiment, the predetermined point at which the trigger is triggered may be a point where the driving pawl engages the stopper element.

In an embodiment, the alarm arrangement may comprise a light emitter that is arranged to emit light upon being triggered or actuated by the trigger.

In an embodiment, the alarm arrangement may comprise a vibrator that is arranged to vibrate upon being triggered or actuated by the trigger.

In an embodiment, the training aid may comprise a communication module, such as a Bluetooth module, that is arranged to transmit a sound to a device connected thereto, when the protruding member has been displaced relative to the housing up to the predetermined point.

In an embodiment, the training aid may comprise a power module such as batteries for providing electrical power to the alarm arrangement and/or the communication module.

BRIEF DESCRIPTION OF DRAWINGS

The objects and features of the present invention will become fully apparent from following the description taken in conjunction with the accompanying drawings. Undertaking that these drawings depict only typical embodiments of the invention and are therefore, not to be considered limiting its scope, the invention will be described and explained with additional specific and detail through the use of the accompanying drawings in which.

In the drawings.

DETAILED DESCRIPTION OF THE PREFERRED EMBODIMENTS

While various inventive aspects, concepts and features of the invention may be described and illustrated herein as embodied in combination in the exemplary embodiments, these various aspects, concepts and features may be used in many alternative embodiments, either individually or in various combinations and sub-combinations thereof. Unless expressly exclude herein all such combinations and sub-combinations are intended to be within the scope of the present invention. Still further, while various alternative embodiments as to the various aspects, concepts and features of the invention—such alternative structures, configurations, methods, devices and components, alternatives as to form, fit and function, and so on may be described herein, such descriptions are not intended to be a complete or exhaustive list of available alternative embodiments, whether presently known or later developed.

Those skilled in the art may readily adopt one or more of the inventive aspects, concepts or features into additional embodiments and uses within the scope of the present invention even if such embodiments are not expressly disclosed herein. Still further, exemplary or representative values and ranges may be included to assist in understanding the present disclosure; however, such values and ranges are not to be construed in a limiting sense and are intended to be critical values or ranges only if so expressly, stated. Moreover, while various aspects, features and concepts may be expressly identified herein as being inventive or forming part of an invention, such identification is not intended to be exclusive but rather there may be inventive aspects, concepts and features that are fully described herein without being expressly identified as such or as part of a specific invention.

Figure 1:
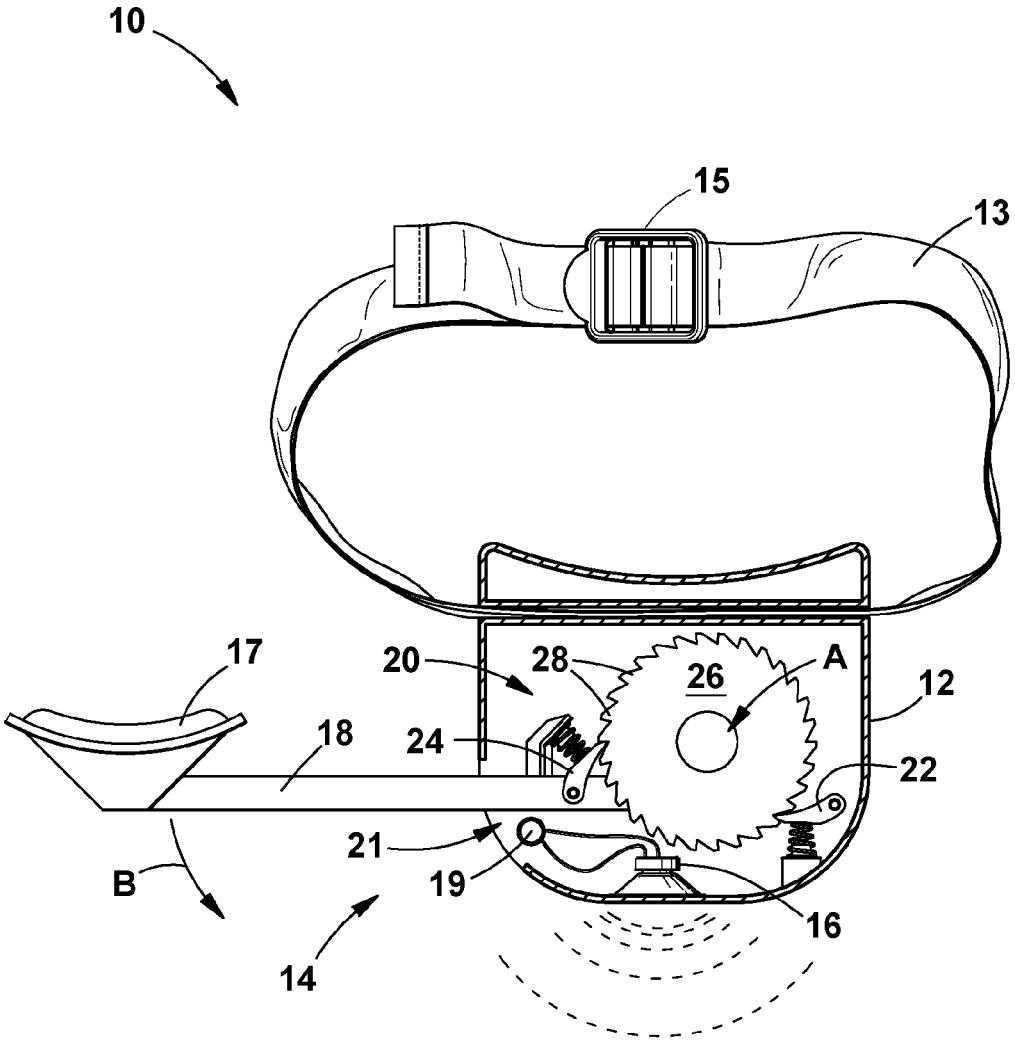
FIG. 1 shows a perspective view of golf training aid in accordance with the invention, and a cutaway view of a housing of the training aid.

As shown in FIG. 1 of the drawings, there is provided a golf training aid in accordance with the invention designated generally by reference numeral 10. The golf training aid comprises a housing 12 that houses a monitoring arrangement 14 and an alarm arrangement 16, such as a vibrator and/or an audible alarm or alarm light.

The golf training aid 10 further comprises a strap 13 that has adjusting member, such as a strap adjuster 15 for attaching and securing the golf training aid 10 on the left thigh of the golfer and above the knee, as will be described below.

In another version of the invention, the strap 13 may be in the form a Velcro strap.

The monitoring arrangement 14 includes a protruding member 18, typically a shaft that protrudes outwardly from an elongate, curved opening 21 defined by the housing 12. A cushion member 17 is fitted at a free end of the protruding member 18. The protruding member 18 is connected to a restricting mechanism 20 comprising a spring-loaded driving pawl 24 that extends from the protruding member 18, a locking pawl 24 that is fitted to the housing, and a toothed ratchet wheel 26 that is rotatably secured to the housing 12 and is arranged to rotate about a rotational axis A which extends in the vertical plane, in use.

The toothed ratchet wheel 26 comprises a series of spaced asymmetrical teeth 26 over which the driving pawl 24 and locking pawl 22 are arranged to slide over when the protruding member 18 is urged to pivot in a first rotational direction in the horizontal plane, between a rest configuration, wherein the protruding member 18 is at a first position (and rest angle,) relative to housing 12 and operably faces the back leg of a golfer prior to the golfer rotating the back leg in the direction of the front leg of the golfer, as will be described below, and a displaced, rotated configuration wherein the protruding member 18 is displaced in the first pivoted direction in the horizontal plane,to a second position (i.e. pivoted position) relative to the housing 12.

The driving pawl 24 and the locking pawl 22 are also arranged to lock with the teeth 28 when the ratchet wheel 26 is displaced in a second rotational direction that is opposite the first rotational direction, or engage the teeth 28 when the driving pawl 24 is displaced in the second direction, to prevent/restrict the protruding member 18 from being voluntarily moved to the rest configuration.

The restricting mechanism 20 further comprises one or more stopper elements (not shown) that is/are arranged to extend from one or more of the teeth 28 to engage with one of the driving pawl 22 or locking pawl 24, so as to prevent further displacement of the protruding member 18 during displacement of the protruding member 18 between the rest and pivoted configurations. The stopper elements (not shown) may be strategically positioned along the teeth 28 such that they can allow the driving pawl 24 and locking pawl 22 to slide over a certain number of teeth 28 before engaging the one or more stopper elements (not shown) so as to ensure that the protruding member 18 can be pivoted, about axis A, in the direction B as shown in FIG. 1, between the rest angle and pivoted angle, in use.

In one version of the invention, the stopper element is in the form of the locking pawl 24 which is arranged to lock to the driving pawl 22 as the driving pawl 22 slides over the teeth 28. The engagement of the driving pawl and locking pawl 22 would prevent the protruding member from pivoting further.

The monitoring arrangement 14 comprises a trigger 19, such as a switch or sensor, that is arranged to trigger the alarm arrangement 16 when the protruding member 18 has been displaced up to a predetermined point relative to the housing 12.

In one version of the invention, the predetermined point at which the alarm is triggered is a point where the driving pawl 24 and/or locking pawl 22 engages the one or more stopper elements (not shown). Accordingly, the sensor 19 is arranged to sense that the driving pawl 24 and/or locking pawl 22 have engaged with the one or more stopper elements (not shown) and upon sensing the contact between the locking pawl 22 and/or driving pawl 24, the sensor 19 is arranged to trigger the alarm arrangement 16.

As will be described below and shown in FIGS. 2 to 8, the protruding member 18 is arranged to rotate/pivot in the horizontal plane between 0 degrees and 90 degrees, preferably between 0 degrees and 60 degrees, more preferably between 0 and 45 degrees.

The golf training aid 10 further comprises a spring-loaded release mechanism (not shown) comprising an actuator mechanism (not shown) which upon actuation allows the locking pawl 22 and/or driving pawl 24 to be moved out of engagement with the teeth 22 or one or more of the stopper elements (not shown) to allow the protruding member 18 to be displaced relative to the housing 12 back to the rest configuration.

Figure 3:
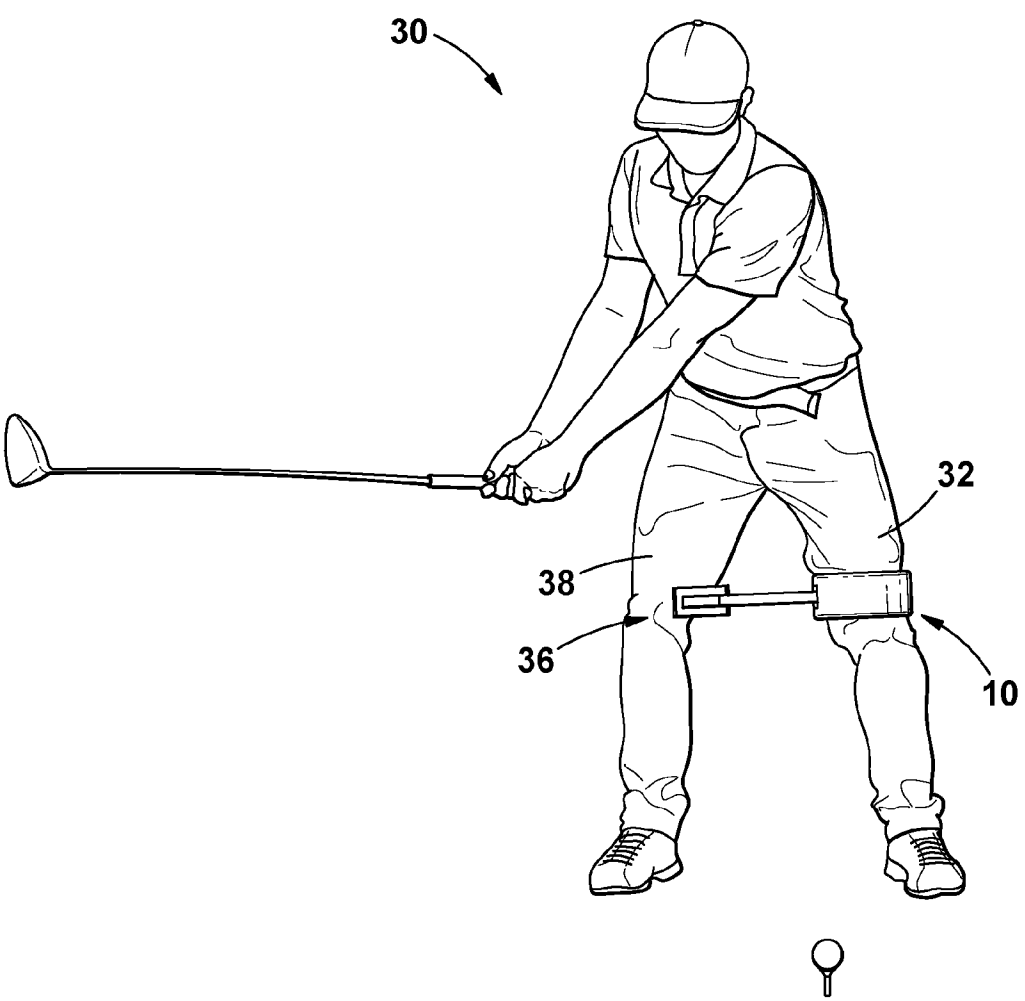
FIGS. 2-8 show the golf training aid in use, with the golf training aid being attached on the front leg of a golfer, and the golfer progressively rotating the back leg relative to the front leg, and the golf training aid monitoring the progressive rotational movement of the back leg relative to the front leg.
Figure 2:
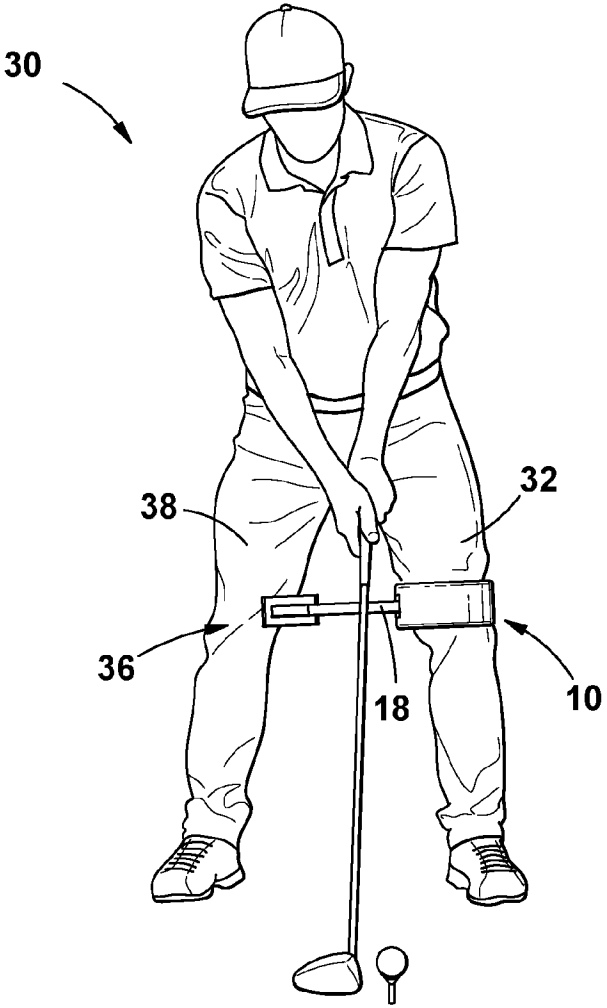
Figure 5:
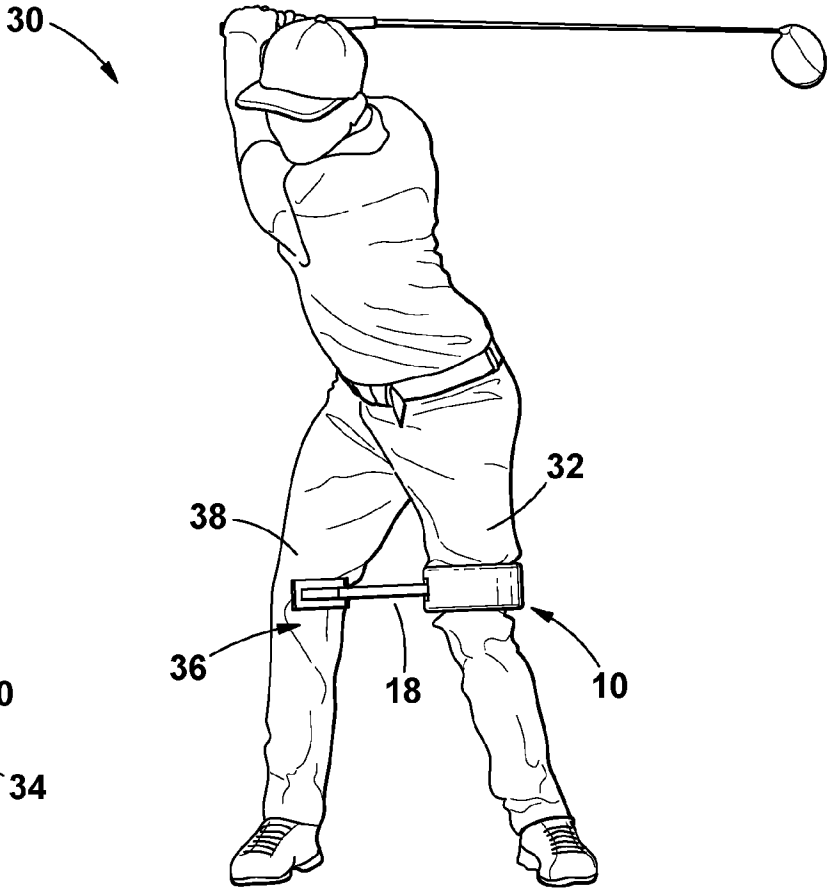
Figure 4:
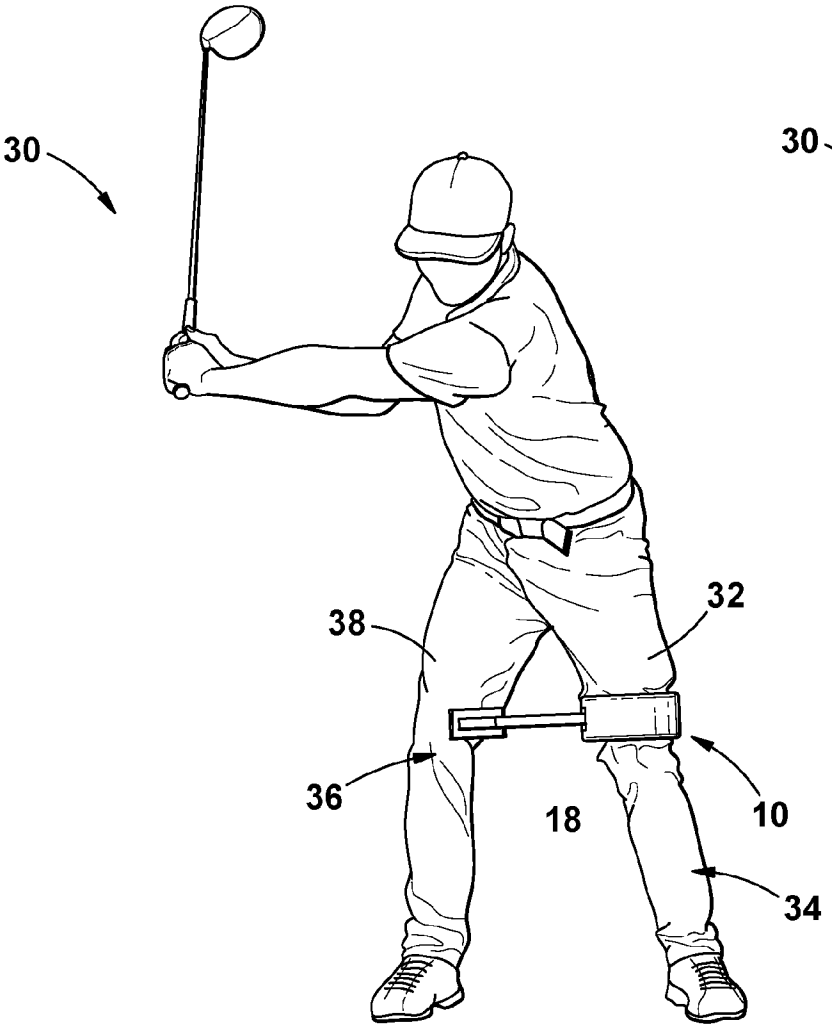

In use, as shown in FIGS. 2 to 8, the golf training aid 10 is attached to a front thigh 32 of a golfer 30 and is positioned above the front knee of the golfer 30, as shown in FIGS. 2 to 8, such that the protruding member 18 faces the back leg 36, more in particular the back thigh 38 of the golfer 30. When the goiter 30 addresses the golf ball as shown in FIG. 2, the protruding member 18 will be forwardly spaced from the back leg 36. As the golfer 30 configures his body from the mid swing position as shown in FIG. 3, to the top swing position as shown in FIG. 4, and accelerating phase position as shown in FIG. 5, the back leg 36 of the golfer 30 rotates relative to the front leg 34.

As the back leg 36 rotates, when the golfer 30 translates his body from the top swing position as shown in FIG. 4, to the acceleration phase position as shown in 5, the knee and/or thigh of the back leg 36 pushes/urges against the protruding member 18, thereby causing the protruding member 18 to be rotatably displaced in the horizontal plane relative to the housing 12 from the rest reference angle, which is defined as zero degrees when the protruding member 18 is not in contact with the back leg 36 of the golfer 30 and the golfer is in the ball addressing position as shown in FIG. 2, to a pivoted angle in which the protruding member 18 is displaced along the curved slot opening 21 up to a predefined point relative to the housing 12, which predefined point corresponds with the rotation of the protruding member 18 to a target pivot angle of preferably between 80 and 95 degrees in the horizontal plane from the rest angle to the pivoted angle.

Figure 6:
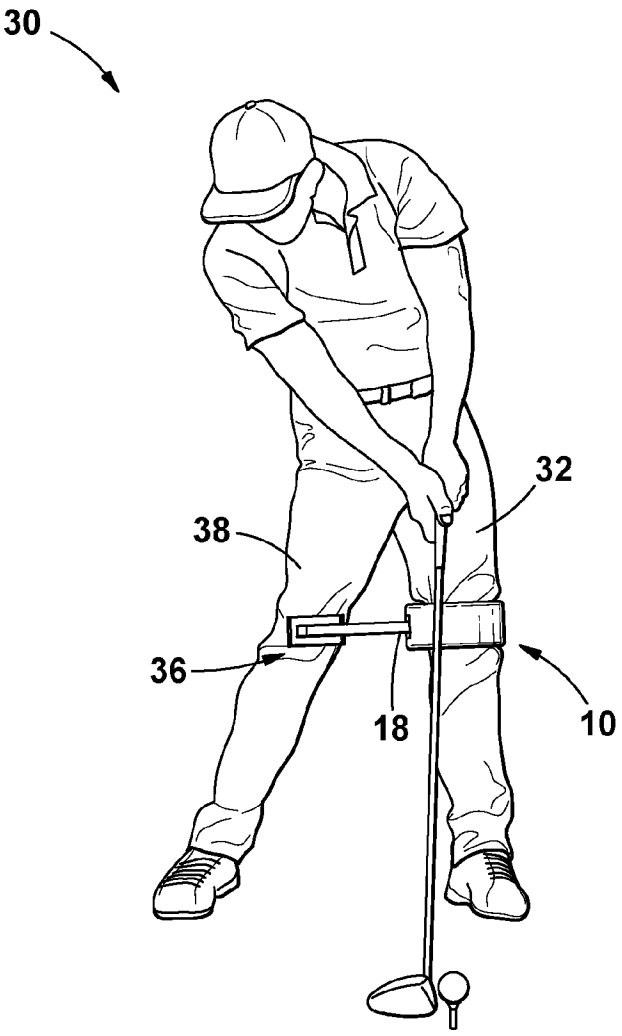
Figure 8:
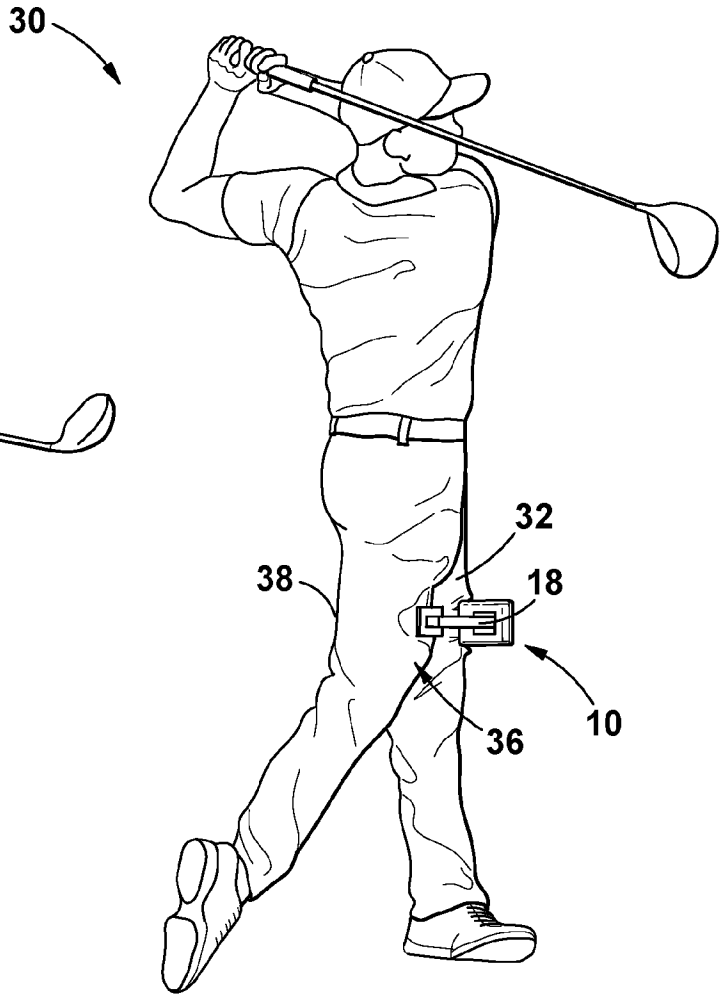
Figure 7:
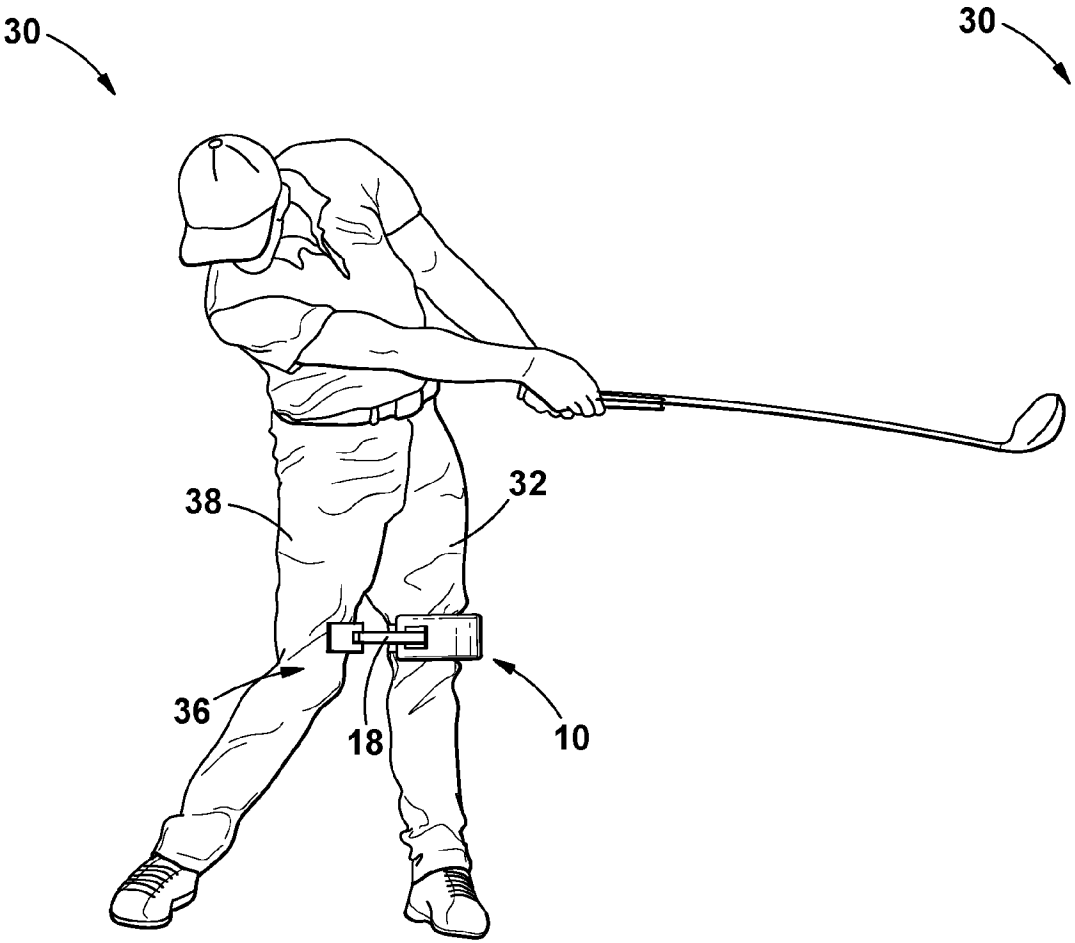

While the protruding member 18 is being displaced to the predetermined point relative to the housing 12., the alarm arrangement 16 is triggered to alarm the golfer 30 that the back leg 36 has been rotated sufficiently to the correct position with respect to the front leg 34, to thereby enable the golfer 30 to progressively translate his body to the ball impact position as shown in FIG. 6, follow through position as shown in FIG. 7, and to the late follow through position as shown in FIG. 8, to complete the striking of the golf ball with the club that is held by the golfer 30. The restricting mechanism 20 will arrest the protruding member 18 to prevent same from being rotated beyond the predefined point upon the alarm arrangement 16 being triggered.

The invention claimed is:

1. A golf training aid arranged to be attached to a front leg of a golfer, the training aid comprising:

a monitoring arrangement for monitoring progressive rotational displacement of a back leg relative to the front leg of the golfer;

an alarm arrangement for alerting the golfer when rotational displacement of the back leg relative to the front leg has reached a predetermined position; and a restricting mechanism for restricting displacement of a protruding member when displaced up to a predetermined point.

2. The training aid according to claim 1, wherein the monitoring arrangement comprises the protruding member, and the protruding member being arranged to be displaced between a rest configuration and a displaced, pivoted configuration in which the protruding member is pivoted in horizontal plane up to the predetermined point which corresponds with the predetermined position which the back leg must reach when being rotated relative to the front leg.

3. The training aid according to claim 2, comprising a housing that defines a slot opening through which the protruding member extends, and the slot opening being arranged to allow the protruding member to be displaceable along the slot opening between the rest configuration and the displaced, pivoted configuration.

4. The training aid according to claim 1, wherein the restricting mechanism comprises:

a toothed ratchet wheel that is secured to the housing;

the protruding member extending away from the toothed ratchet wheel and arranged to pivot relative to the ratchet wheel;

a driving pawl extending from the protruding member for engaging the toothed ratchet wheel to allow the protruding member to pivot relative to the ratchet wheel when being displaced between the rest and pivoted configurations; and at least one stoper element for engaging the driving pawl when the protruding member has been displaced up to the predetermined point, to disallow the protruding member from being displaced further beyond the predetermined point.

5. The training aid according to claim 1, wherein the monitoring arrangement comprises a trigger that is arranged to trigger the alarm arrangement when the protruding member has been displaced up to the predetermined point.

6. The training aid according to claim 5, wherein the predetermined point at which the trigger is triggered is a point where the driving pawl engages a stopper element.

7. The training aid according to claim 1, comprising a release mechanism for releasing the protruding member from engagement with the restricting mechanism.

* * * * *